US006565277B1

(12) United States Patent
Huang

(10) Patent No.: US 6,565,277 B1
(45) Date of Patent: May 20, 2003

(54) PAPER FASTENER HAVING FOLDED AND SHIELDED SIDE EDGES

(76) Inventor: Jien Wei Huang, 7F, No. 46, Pin Ho 10 Street, Chang Hua (TW), 500

( * ) Notice: Subject to any disclaimer, the term of this patent is extended or adjusted under 35 U.S.C. 154(b) by 0 days.

(21) Appl. No.: 10/087,851

(22) Filed: Mar. 5, 2002

(51) Int. Cl.[7] ..... B42F 13/06; B42F 13/08; B42D 1/00

(52) U.S. Cl. ..... 402/8; 402/14; 402/15; 402/17; 402/64; 402/68; 24/67 R; 24/67.5; 24/67.11

(58) Field of Search ..... 402/8, 14, 15, 402/17, 64, 68; 24/67 R, 67.5, 67.11

(56) References Cited

U.S. PATENT DOCUMENTS 1,978,569 A * 10/1934 Dayton ..... 241/169
2,182,058 A * 12/1939 Ross ..... 402/17
3,994,606 A * 11/1976 Messmer ..... 402/17
4,620,812 A * 11/1986 Kim ..... 402/14
4,979,841 A * 12/1990 Lauder ..... 402/15
5,011,318 A * 4/1991 Gilmore ..... 402/14
5,096,323 A * 3/1992 Walker ..... 402/15
5,810,498 A * 9/1998 Hirai ..... 402/18
5,988,925 A * 11/1999 Baggett ..... 402/60
6,217,246 B1 4/2001 Yu ..... 402/8
6,394,685 B1 * 5/2002 Lee ..... 402/14

* cited by examiner

*Primary Examiner*—Valencia Martin-Wallace
*Assistant Examiner*—Mark T. Henderson

(57) ABSTRACT

A paper fastener includes a base having two end legs for engaging through sheet materials to be clamped and having two side panels bent relative to the base and two outer flanges folded relative to the side panels and shielded by the side panels. A bar includes two end orifices for receiving the legs of the base, and includes two side flaps bent relative to the bar and two outer flanges folded relative to the side flaps and shielded by the side flaps of the bar. Two retainers are slidably engaged on the bar for securing the paper sheets between the base and the bar.

1 Claim, 3 Drawing Sheets

PAPER FASTENER HAVING FOLDED AND SHIELDED SIDE EDGES

BACKGROUND OF THE INVENTION

1. Field of the Invention

The present invention relates to a paper fastener, and more particularly to a paper fastener having side flanges folded and shielded for preventing the burred side flanges of the paper fastener from hurting users.

2. Description of the Prior Art

U.S. Pat. No. 6,217,246 to Yu discloses one of the typical paper fasteners. FIG. 1 shows the cross sectional view of Yu's paper fastener which includes a base 20 having two folded side flanges 21 and having two end prongs 22, a compressor 10 having two holes for receiving the prongs 22 and also having two folded side flanges 12, and two retainers slidably engaged onto the compressor 10 for engaging with the folded prongs 22 and for detachably securing the compressor 10 and the base 20 together. However, the compressor 110 and the base 20 are normally made by punching processes, such that the folded side flanges 12, 21 of the compressor 10 and the base 20 may be rough or serrated or burred. In addition, the compressor 10 and the base 20 have not been suitably shielded or covered, such that the compressor 10 and the base 20 may easily hurt the users.

The present invention has arisen to mitigate and/or obviate the afore-described disadvantages of the conventional paper fasteners.

SUMMARY OF THE INVENTION

The primary objective of the present invention is to provide a paper fastener including folded side flanges that may be shielded for preventing the burred side flanges of the paper fastener from hurting users.

In accordance with one aspect of the invention, there is provided a paper fastener comprising a base including two ends each having a leg extended therefrom and foldable relative to the base for engaging through sheet materials, the base including two side panels bent relative to the base for forming a bent portion between the side panels.and the base respectively, the side panels being located lower than the base for forming a recess between the base and the side panels respectively, the side panels each including an outer flange folded relative to the side panels respectively and engaged into the recess of the base and engaged with the side panels respectively, the outer flanges of the side panels each including a free edge located beside the bent portions of the base and shielded by the bent portions and the side panels of the base respectively, a bar including two end orifices for receiving the legs of the base and for engaging onto the sheet materials, the legs of the base being foldable to engage onto the bar for clamping the sheet materials between the base and the bar, the bar including two side flaps bent relative to the bar for forming a bent portion between the side flaps and the bar respectively, the side flaps being located higher than the bar for forming a recess between the bar and the side flaps respectively, the side flaps each including an outer flange folded relative to the side flaps respectively and engaged into the recesses of the bar and engaged with the side flaps respectively, the outer flanges of the side flaps each including a free edge located beside the bent portions and shielded by the bent portions and the side flaps of the bar, and two retainers slidably engaged on the bar for engaging with the legs and for securing the paper sheets between the base and the bar.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
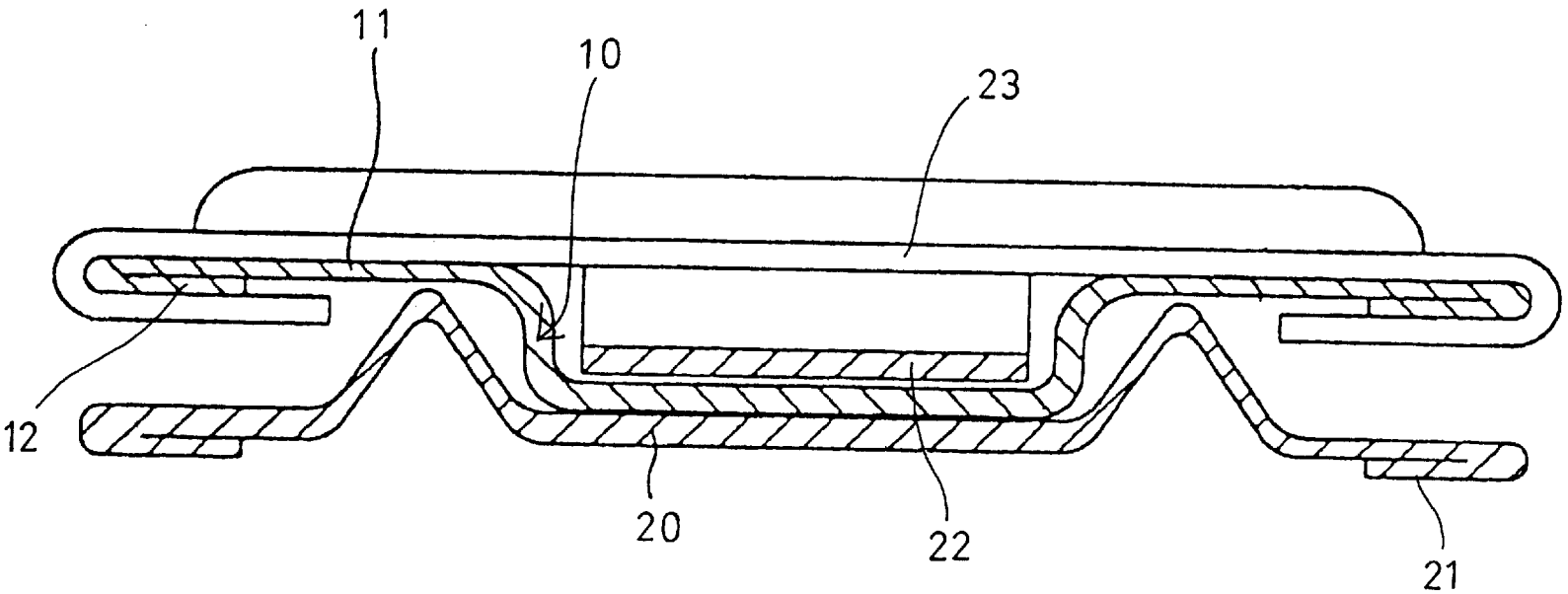
FIG. 1 PRIOR ART
FIG. 1 is a cross sectional view illustrating one of the typical paper fasteners.
Figure 2:
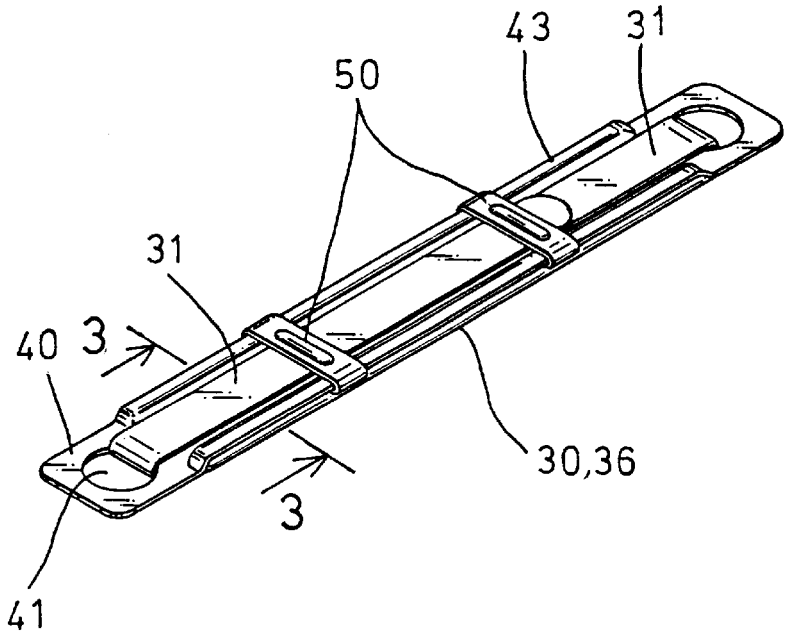
FIG. 2 is a perspective view of a paper fastener in accordance with the present invention.
Figure 3:
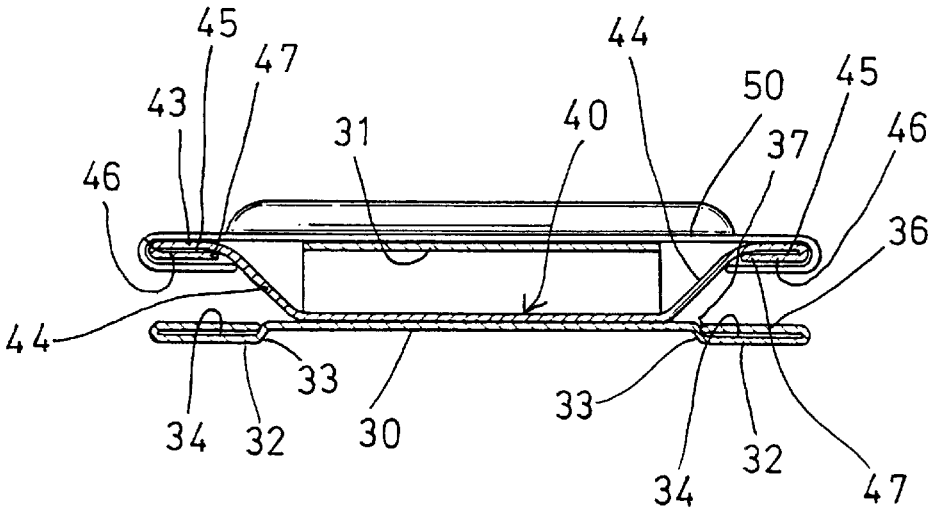
FIG. 3 is a cross sectional view taken along lines 3—3 of FIG. 2.
Figure 4:
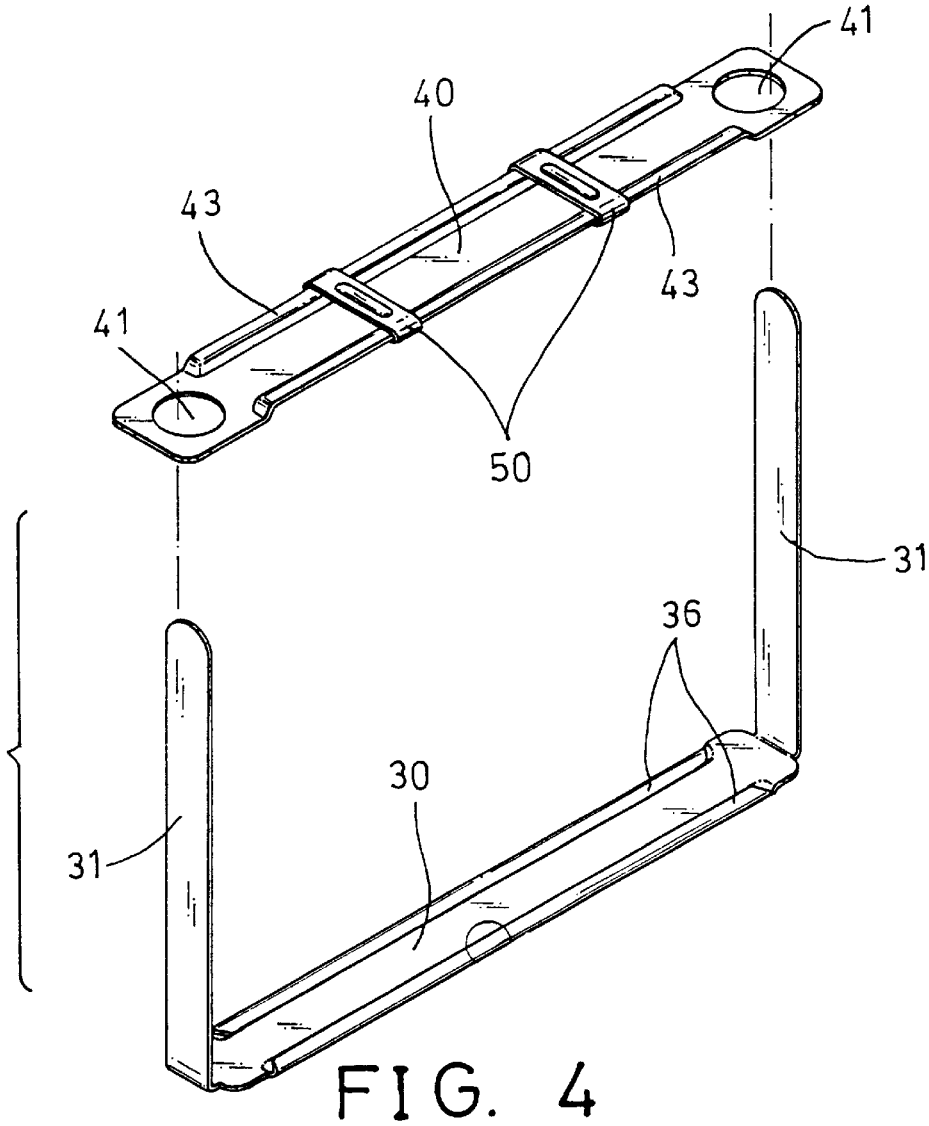
FIG. 4 is a partial exploded view of the paper fastener.

Referring to the drawings, and initially to FIGS. 2–4, a paper fastener in accordance with the present invention comprises a base 30 including two ends each having a leg 31 extended therefrom for engaging through the respective holes of the paper sheets to be clamped, and including two side panels 32 hammered or forged relative to the base 30 for forming a bent portion 33 between the side panels 32 and the base. The side panels 32 are substantially parallel to the base 30, and are located slightly lower than the base 30 (FIGS. 3, 5) for forming a shoulder or a recess 34 between the base 30 and the side panels 32 respectively.

Figure 5:
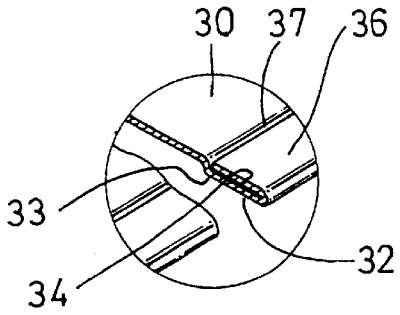
FIGS. 5 and 6 are enlarged partial perspective views illustrating the folded and shielded side flanges of the paper fastener.

As best shown in FIGS. 3–5, the side panels 32 each includes an outer flange 36 folded upward relative to the side panels 32 respectively and then folded downward to engage into the recesses 34 of the base 30 and to engage with the side panels 32 respectively. The outer flanges 36 of the side panels 32 each includes a free edge 37 where normally may have the burrs or rough members formed thereon. The free edges 37 of the outer flanges 36 of the side panels 32 are engaged with the bent portions 33 or located beside the bent portions 33 for allowing the outer flanges 36 of the side panels 32 to be shielded by the bent portions 33 and the side panels 32 of the base 30.

A bar 40 includes two end orifices 41 for receiving the legs 31 of the base 30, for allowing the bar 40 to be engaged onto the paper sheets to be clamped. The legs 31 of the base 30 may then be folded to engage onto the bar 40 (FIG. 2) as that of the typical paper fasteners. The bar 40 includes two side flaps 43 hammered or forged relative to the bar 40 for forming a bent portion 44 between the side flaps 43 and the bar 40. The side flaps 43 are substantially parallel to the bar 40, and are located slightly higher than the bar 40 (FIGS. 3, 6) for forming a shoulder or a recess 45 between the bar 40 and the side flaps 43 respectively. Two retainers 50 are slidably engaged on the bar 40 for engaging with the legs 31 and for securing the paper sheets between the base 30 and the bar 40.

Figure 6:
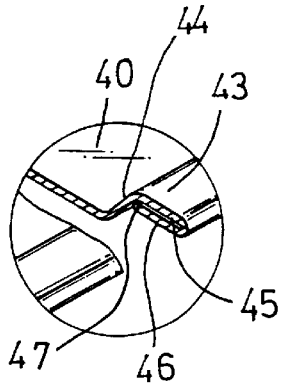

As best shown in FIGS. 3, 4 and 6, the side flaps 43 each includes an outer flange 46 folded downward relative to the side flaps 43 respectively and then folded upward to engage into the recesses 4, 5 of the bar 40 and to engage with the side flaps 43 respectively. The outer flanges 46 of the side flaps 43 each includes a free edge 47 where normally may have the burrs or rough members formed thereon. The free edges 47 of the outer flanges 46 of the side flaps 43 are engaged with the bent portions 44 or located beside the bent portions 44 for allowing the outer flanges 46 of the side flaps 43 to be shielded by the bent portions 44 and the side flaps 43 of the bar 40.

As best shown in FIGS. 3, 5 and 6, the outer flanges 36, 46 of the side panels 32 and the side flaps 43 may thus be shielded or protected, such that the users may be prevented from being cut or hurt by the burred edges of the outer flanges 36, 46 of the side panels 32 and the side flaps 43. The bent portions 33, 44 of the base 30 and the bar 40 may also be used for increasing the bending strength of the base 30 and the bar 40 respectively.

Accordingly, the paper fastener in accordance with the present invention includes folded side flanges that may be shielded for preventing the burred side flanges of the paper fastener from hurting users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A paper fastener comprising:

a base including two ends each having a leg extended therefrom and foldable relative to said base for engaging through sheet materials, said base including two side panels bent relative to said base to form a bent portion between said side panels and said base respectively, said side panels being located lower than said base to form a recess between said base and said side panels respectively, said side panels each including an outer flange folded relative to said side panels respectively and engaged into said recess of said base and engaged with said side panels respectively, said outer flanges of said side panels each including a free edge located beside said bent portions of said base and shielded by said bent portions and said side panels of said base respectively, to prevent said free edge of said outer flange of said side panel from being exposed, a bar including two end orifices to receive said legs of said base, for engaging onto the sheet materials, said legs of said base being foldable to engage onto said bar, to clamp the sheet materials between said base and said bar, said bar including two side flaps bent relative to said bar to form a bent portion between said side flaps end said bar respectively, said side flaps being located higher than said bar to form a recess between said bar and said side flaps respectively, said side flaps each including an outer flange folded relative to said side flaps respectively and engaged into said recesses of said bar and engaged with said side flaps respectively, said outer flanges of said side flaps each including a free edge located beside said bent portions and shielded by said bent portions and said side flaps of said bar, to prevent said free edge of said outer flange of said side flap from being exposed, and two retainers slidably engaged on said bar to engage with said legs, for securing the paper sheets between said base and said bar.

* * * * *